US006098497A

United States Patent [19]

Larose

[11] Patent Number: 6,098,497

[45] Date of Patent: Aug. 8, 2000

[54] BOTTLE OPENING DEVICE

[76] Inventor: Chantale Larose, 303 Covey Hill Road, Hemmingford, Quebec, Canada, J0L 1H0

[21] Appl. No.: 09/252,863

[22] Filed: Feb. 18, 1999

[51] Int. Cl.[7] ..... B67B 7/14

[52] U.S. Cl. ..... 81/3.4; 7/151; 368/10

[58] Field of Search ..... 81/3.4, 3.08, 3.09, 81/3.55, 3.56, 125; 7/151; 368/10; 2/160

[56] References Cited

U.S. PATENT DOCUMENTS

| | | | |
|---|---|---|---|
| D. 261,854 | 11/1981 | Nielson . | |
| 1,578,627 | 3/1926 | Baumgarten . | |
| 2,674,909 | 4/1954 | Morris | 81/3.08 |
| 3,048,067 | 8/1962 | Miles et al. | 81/3.08 |
| 3,453,911 | 7/1969 | Carter . | |
| 3,812,741 | 5/1974 | Heine . | |
| 4,235,132 | 11/1980 | Kendall . | |
| 4,414,865 | 11/1983 | Brooks et al. | 81/3.09 |
| 4,433,597 | 2/1984 | Rowland | 81/3.09 |
| 4,702,129 | 10/1987 | Allen . | |
| 4,846,025 | 7/1989 | Keller et al. | 81/3.09 |
| 4,894,866 | 1/1990 | Walker . | |
| 5,133,233 | 7/1992 | Erwin . | |
| 5,261,299 | 11/1993 | Kondos . | |
| 5,276,922 | 1/1994 | Floyd, Jr. . | |
| 5,329,832 | 7/1994 | Tegethoff . | |
| 5,770,297 | 6/1998 | Grubich . | |
| 5,933,893 | 8/1999 | Padden | 7/158 |

FOREIGN PATENT DOCUMENTS

| | | |
|---|---|---|
| 517142 | 1/1940 | United Kingdom . |
| WO 94/11295 | 5/1994 | WIPO . |

*Primary Examiner*—D. S. Meislin
*Attorney, Agent, or Firm*—Richard C. Litman

[57] ABSTRACT

A bottle opening device worn on the user's hand or wrist. The bottle opener includes a round member having interior ridges and grooves for mating with a twist-off bottle cap, a slidable hook for removing a pry-off bottle cap, and a magnet for retaining the bottle cap. The bottle opener may include a watch, a sound emitter such as an alarm, and a light, possibly to assist with reading the watch.

16 Claims, 6 Drawing Sheets

BOTTLE OPENING DEVICE

BACKGROUND OF THE INVENTION

1. Field of the Invention

The present invention relates to bottle openers Specifically, the invention is a bottle opener which opens both twist open and pry open caps, which is worn on the hand or wrist, and which may include a watch.

2. Description of the Related Art

Bartenders frequently serve customers beer in bottles having caps which are difficult to remove. Most beer bottle caps either must be pried off using a bottle opener, or twisted off by grasping excessively sharp ridges around the edge of the cap. When a bartender needs to remove the cap, their bottle opener is frequently not within easy reach, causing the bartender to use his hands. Opening multiple bottles with one's bare hands sometimes results in cuts, and is always unpleasant.

Several other inventors have proposed various bottle openers. However, no inventor within the knowledge of the present inventor has proposed a bottle opener worn on the hand or wrist which stays completely out of the way when not in use, and which also serves as a watch.

U.S. Pat. No. Des. 261,854, issued to Fred Nielsen on Nov. 17, 1981, shows a twist-off cap gripper.

U.S. Pat. No. 1,578,627, issued to J. C. Baumgarten on Mar. 30, 1926, describes a bottle opener which is worn as a ring. The bottle opener includes a slot for prying off bottle caps, and a point at the top of the slot for perforating the top of the bottlecap to equalize air pressure. Unlike Baumgarten, The present invention avoids the necessity of having a sharp edge protruding from the ring.

U.S. Pat. No. 3,453,911, issued to Frank H. Carter on Jul. 8, 1969, describes a grip and twist bottle cap remover. The bottle cap remover has a hand engaging member on one side of an elongated member, and a finger engaging member slidably mounted to the elongated member. The hand engaging member and finger engaging member are squeezed together around the bottle cap, making the cap easier to grasp.

U.S. Pat. No. 3,812,741, issued to Charles A. Heine on May 28, 1974, describes a bottle cap remover. The bottle cap remover has a ring-like structure, with grooves and ridges on the interior surface corresponding to the grooves and ridges on the bottle cap, and a second set of grooves and ridges on the exterior surface for grasping. The bottle cap remover may include a key chain.

U.S. Pat. No. 4,235,132, issued to Robert R. Kendall on Nov. 25, 1980, describes a cap twister bottle opener. The bottle opener has a pair of rings, with each ring having a thick portion and a thin portion, with bottle cap engaging teeth on the thick portions. The rings are pivotally secured together by a pin passing through the thick portion of one ring and the thin portion of the other ring. Placing the rings around a bottle cap and sliding the rings so that the teeth move together engages the bottle cap for turning.

U.S. Pat. No. 4,702,129, issued to Louis Allen on Oct. 27, 1987, describes a gripper for container caps. The gripper is made from resilient material, and defines a recess for receiving a bottle cap. Grasping the exterior, applying pressure, and twisting causes the gripper to retain and turn the bottle cap.

U.S. Pat. No. 4,894,866, issued to Caroline L. Walker on Jan. 23, 1990, describes a bartender's glove. The glove has an index finger portion and a thumb portion, with a leather grip affixed between the index finger and thumb. The leather grip is used to frictionally grip a twist off bottle cap. This invention provides no means for removing a pry off type cap.

U.S. Pat. No. 5,133,233, issued to Charles M. Erwin on Jul. 28, 1992, describes a bottle opener glove. The glove includes a cap-engaging hook and a fulcrum bar affixed to a rigid back plate. The back plate is attached to the palm portion of the glove. Unlike Erwin, the present invention avoids the necessity of having the bottle opener affixed to the palm, preventing use of the hand for other purposes.

U.S. Pat. No. 5,261,299, issued to Stephen Kondos on Nov. 16, 1993, describes a bottle opener. The bottle opener is basically a conventional opener having a handle attached to a flexible piece of material. The piece of material has a wrist strap at one end and a pair of finger holes on the other end, so that the bottle opener is secured to the user's hand. Unlike Kondos, the present invention allows full use of the hand while the bottle opener is in use.

U.S. Pat. No. 5,276,922, issued to George M. Floyd, Jr. on Jan. 11, 1994, describes a bartender's glove. The glove includes a bottle opener attached to the upper palm portion, a padded area between the thumb and index finger for twisting off bottle caps, a cigarette lighter, and a marker or pencil within the index finger portion. Unlike Floyd, the present invention avoids the necessity of constantly having the bottle opener attached to the palm of the hand.

U.S. Pat. No. 5,329,832, issued to Ronald E. Tegethoff on Jul. 19, 1994, describes a pull tab can opener. The opener includes hook extending from a finger band.

U.S. Pat. No. 5,770,297, issued to Ivan J. Grubich on Jun. 23, 1998, describes a gripping device. The device is a strip of flexible material with a band on each end. One band secures the strip to the thumb, and the other band secures the strip to the index finger.

U.K. Pat. No. 517,142, published on Jan. 22, 1940, describes a bottle opener for bottles having rotatable caps. The bottle opener includes a forked end, with each fork having teeth for engaging the bottle cap. An additional arm is located between the fork members, in a slightly higher plane, which rests on top of the bottle cap while the bottle opener is in use, preventing the opener from slipping downwards.

International Application No. WO 94/11295, published on May 26, 1994, describes a forearm openable closure for containers. The opener is intended for use by people who have reduced manual dexterity. The opener has upwardly extending forearm engaging members, which may fold against the side of the container when not in use.

None of the above inventions provides a bottle opener which is worn by the user, opens both twist and pry off type caps, remains totally out of the user's way until needed, and is combined with a watch. None of the above inventions and patents, taken either singularly or in combination, is seen to describe the instant invention as claimed. Thus a bottle opening device solving the aforementioned problems is desired.

SUMMARY OF THE INVENTION

The invention is a bottle opener for wearing on the hand or wrist. The opener includes a base, a bottle cap grasping member, and a band.

The base has the approximate configuration of a wristwatch. Either end of the base is configured to receive a wristband. Any band suitable for fastening around a wrist or hand may be used, and a watchband attached to the base by spring bars typically used with such watch bands is suggested. The band will ideally fasten using hook and loop fasteners such as those marketed under the trademark, VELCRO, allowing the user to easily adjust the band to different lengths.

The center of the base may include a magnet for retaining a bottle cap. Alternatively, the center of the base may include a watch. If a watch is included, a magnet should not be used. The watch face is recessed to protect it from damage when the bottle opener is used. The opener base may also include a sound emitter, such as an alarm for the watch, or a light, possibly for reading the watch in the dark.

A circular member extends upward from the base. The circular member has a hollow interior, and a series of interior grooves are ridges corresponding to the grooves and ridges of a beer bottle cap. The interior ridge to ridge diameter of the circular member is slightly larger than the exterior groove to groove diameter of a typical bottle cap. Likewise, the interior groove to groove diameter of the circular member is slightly larger than the ridge to ridge diameter of the bottle cap. The circular member includes at least one opening to allow for removal of the bottle cap after opening the bottle, and preferably includes at least two openings if a watch is included on the opener, allowing the watch to be worn on either hand with one opening conveniently reachable by the other hand. A typical bottle cap has 21 ridges, so an opener with one gap will preferably have 19 grooves.

To use the opener for a twist-off cap, the opener is placed on top of the cap without removing it from the hand or wrist. The bottle is then rotated clockwise, thereby causing the cap to rotate counterclockwise with the bottle as the frame of reference, removing the cap. The cap is then removed from the opener by inserting a finger through the opening in the circular member.

The circular member may also include a sliding hook for removal of pry-off caps. The hook will be located within one edge of the circular member, opposite the base. The hook retracts to allow the cap to enter the opener, then extends to grasp under the cap, allowing a pry-off cap to be removed. The upward pressure of the hook, combined with the downward pressure of the base on the opposite side of the cap, pries the cap off of the bottle. The hook is then retracted, and a finger inserted into the circular member's opening to remove the cap.

By providing a wrist strap suitable for use with the user's hand or wrist, the user may choose to wear the bottle opener on either hand or on either wrist, with the base adjacent to the front or the back of the hand. This allows the user to position the bottle opener wherever it will perform its function easily, while not interfering with the user's other tasks. The bottle opener is always within easy reach when needed, and is kept within easy reach in a hands-free manner.

Accordingly, it is a principal object of the invention to provide a bottle opener worn on the wrist or hand of the user, in a manner which does not interfere with any of the user's tasks.

It is another object of the invention to provide a bottle opener capable of opening either twist-off or pry-off bottle caps.

It is a further object of the invention to prevent cuts to the user's hand by ensuring that a bottle opener is always within easy reach.

Still another object of the invention is to provide a bottle opener combined with a watch, allowing the same tool to perform multiple functions.

An additional object of the invention is to provide a bottle opener having sound and/or light emitters.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
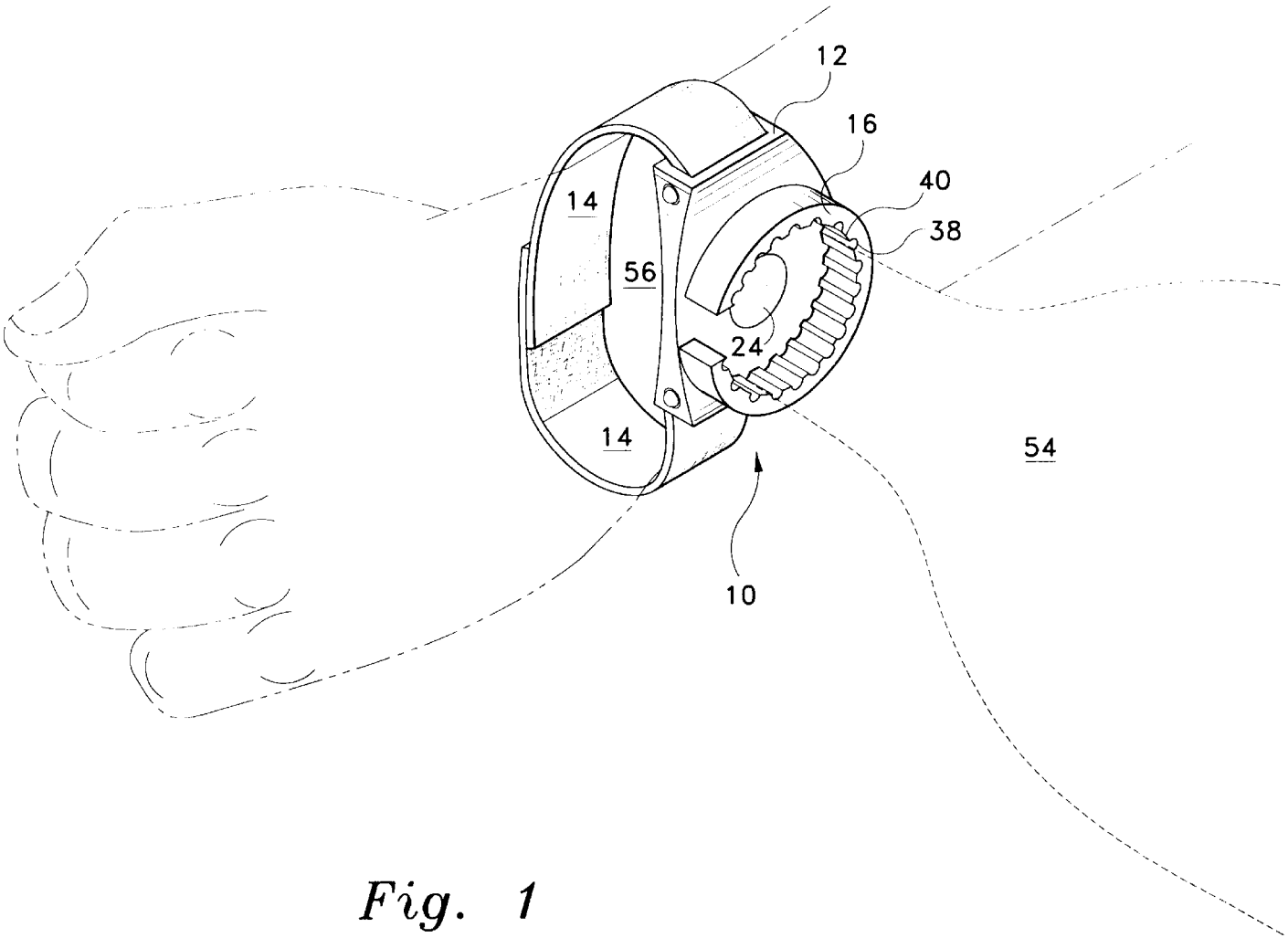
FIG. 1 is an environmental, perspective view of a bottle opening device according to the present invention.
Figure 2:
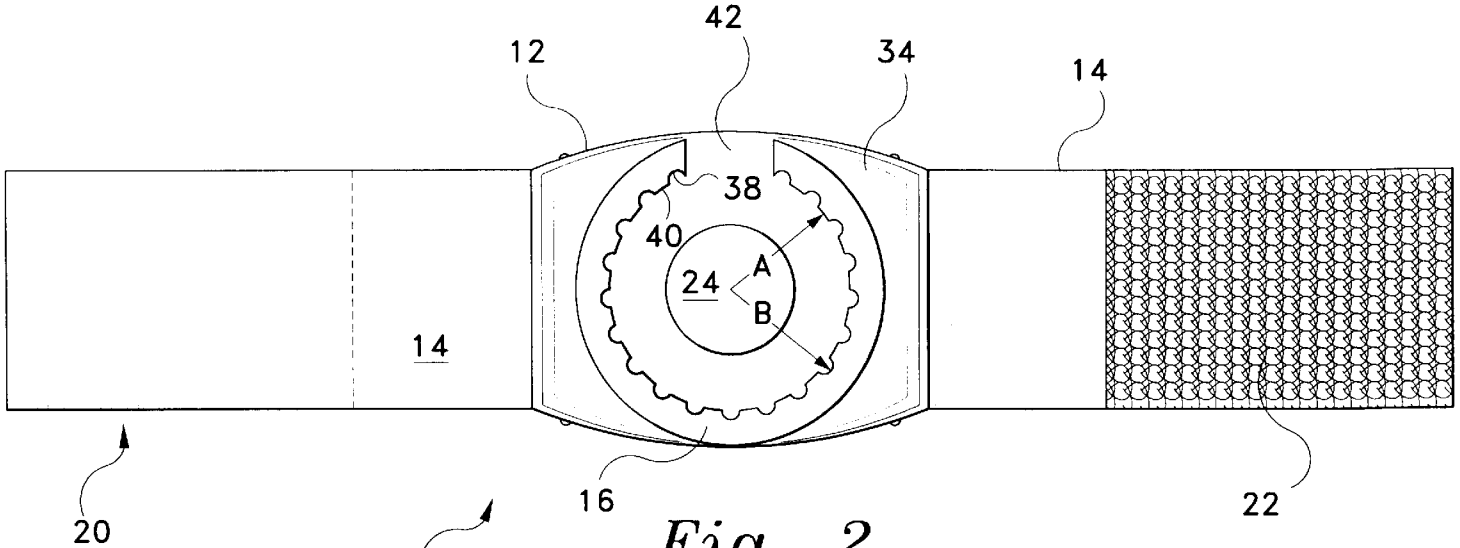
FIG. 2 is a front view of a bottle opening device according to the present invention.
Figure 3:
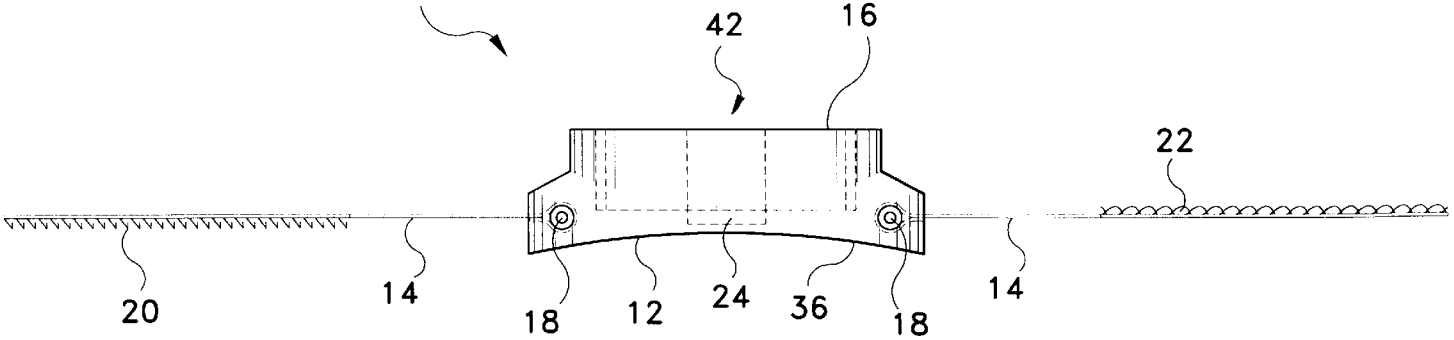
FIG. 3 is a side view of a bottle opening device according to the present invention.
Figure 4:
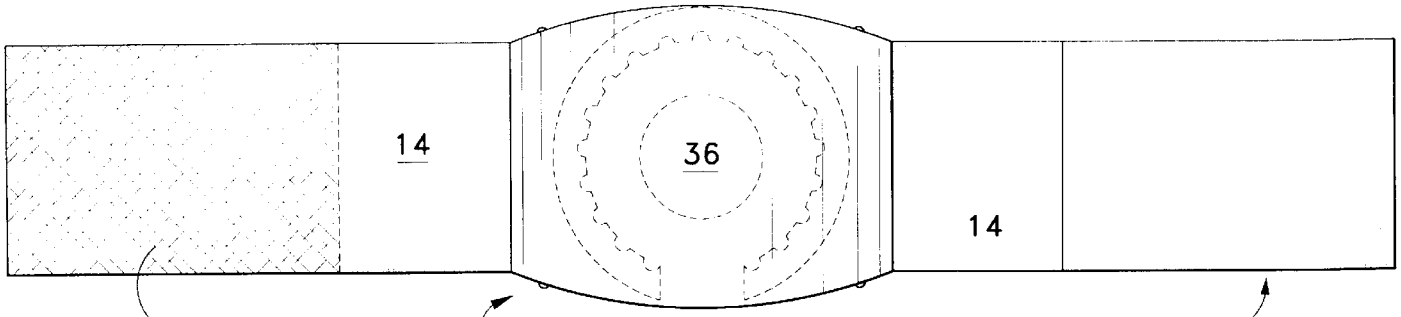
FIG. 4 is a rear view of a bottle opening device according to the present invention.
Figure 5:
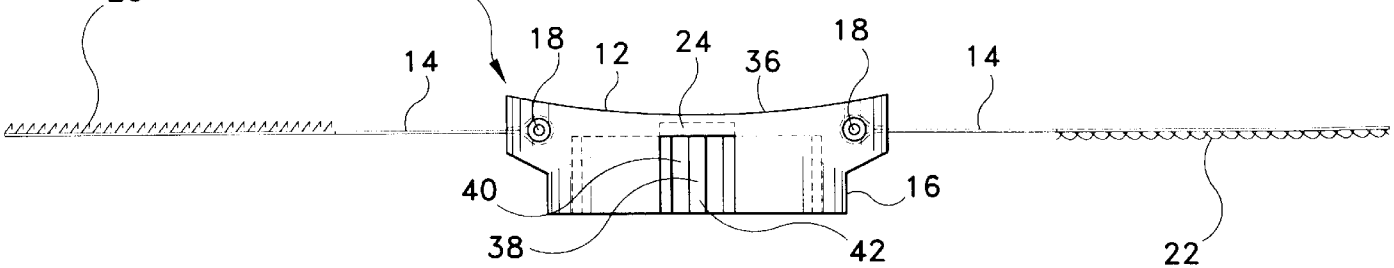
FIG. 5 is a side view of a bottle opening device according to the present invention.
Figure 6:
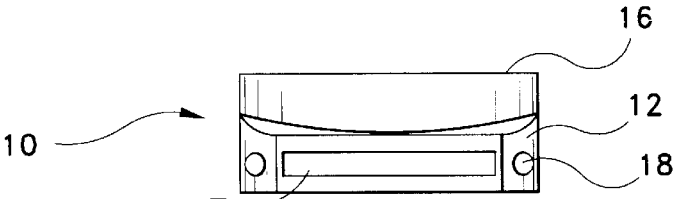
FIG. 6 is an end view of a bottle opening device according to the present invention.

The present invention is a bottle opener worn on the hand or wrist of the user. Referring to FIGS. 2–6, the bottle opener 10 includes a base 12, a band 14, and a circular member 16.

The base 12 is configured in a manner similar to a conventional watch. The rear surface 36 of base 12 is preferably slightly curved to conform to the shape of a wrist. Each end of base 12 preferably receives attachment means for a band, such as watch band spring bars 18. The band 14 attaches to spring bars 18, extending from either end of the base 12. The band 14 may be any band suitable for securing base 12 to a hand or wrist, and any typical watch band is suggested. Ideally, band 14 will secure using mating hook and loop fasteners, with hooks 20 and loops 22. A typical hook and loop fastener is marketed under the trademark, VELCRO. A band 14 of this type will allow a user to quickly adjust its length to fit around either a hand or a wrist.

Figures 7, 8:
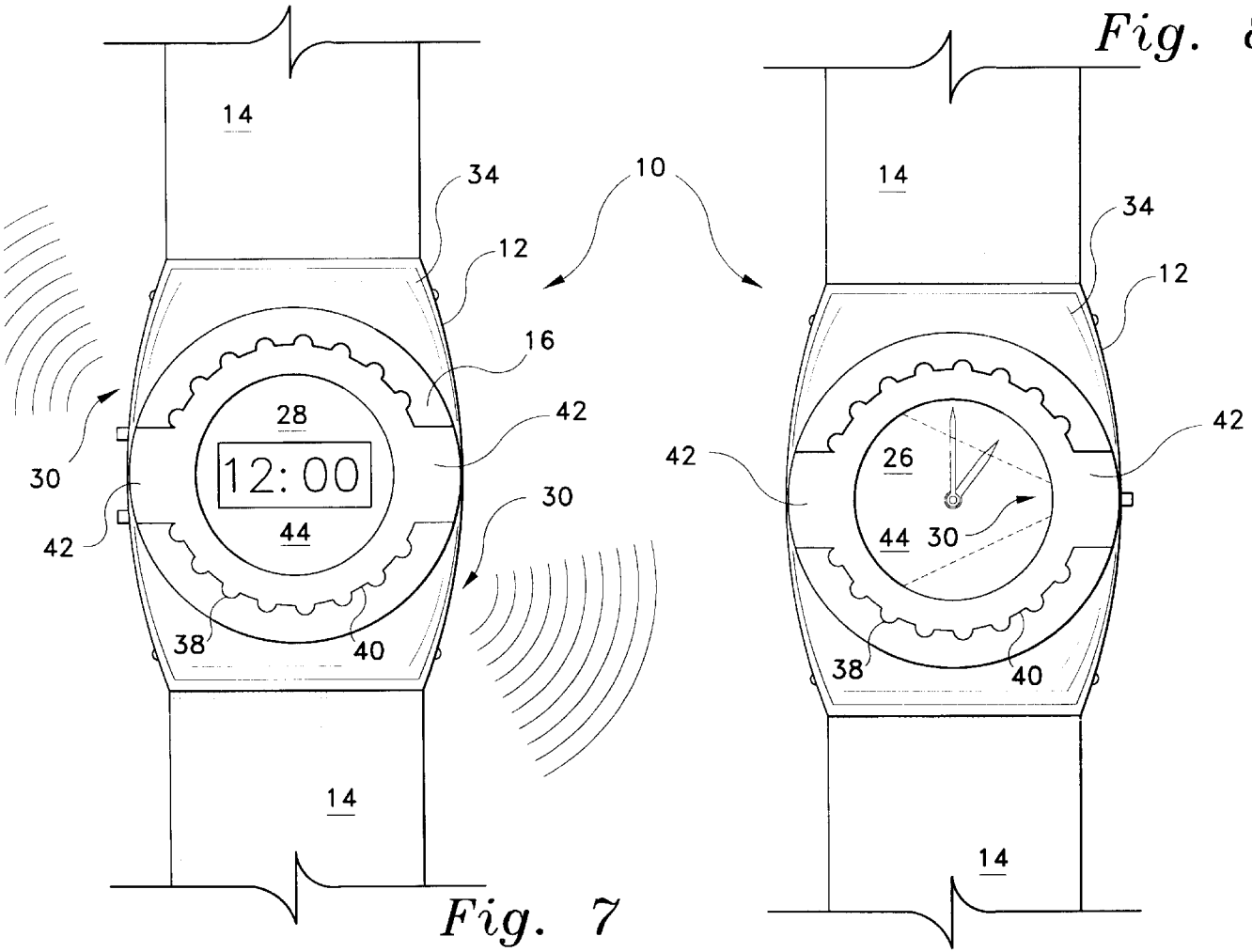
FIG. 7 is a front view of a bottle opening device according to the present invention, showing the sound emitter.
FIG. 8 is a front view of a bottle opening device according to the present invention, showing the light emitter.
Figure 9:
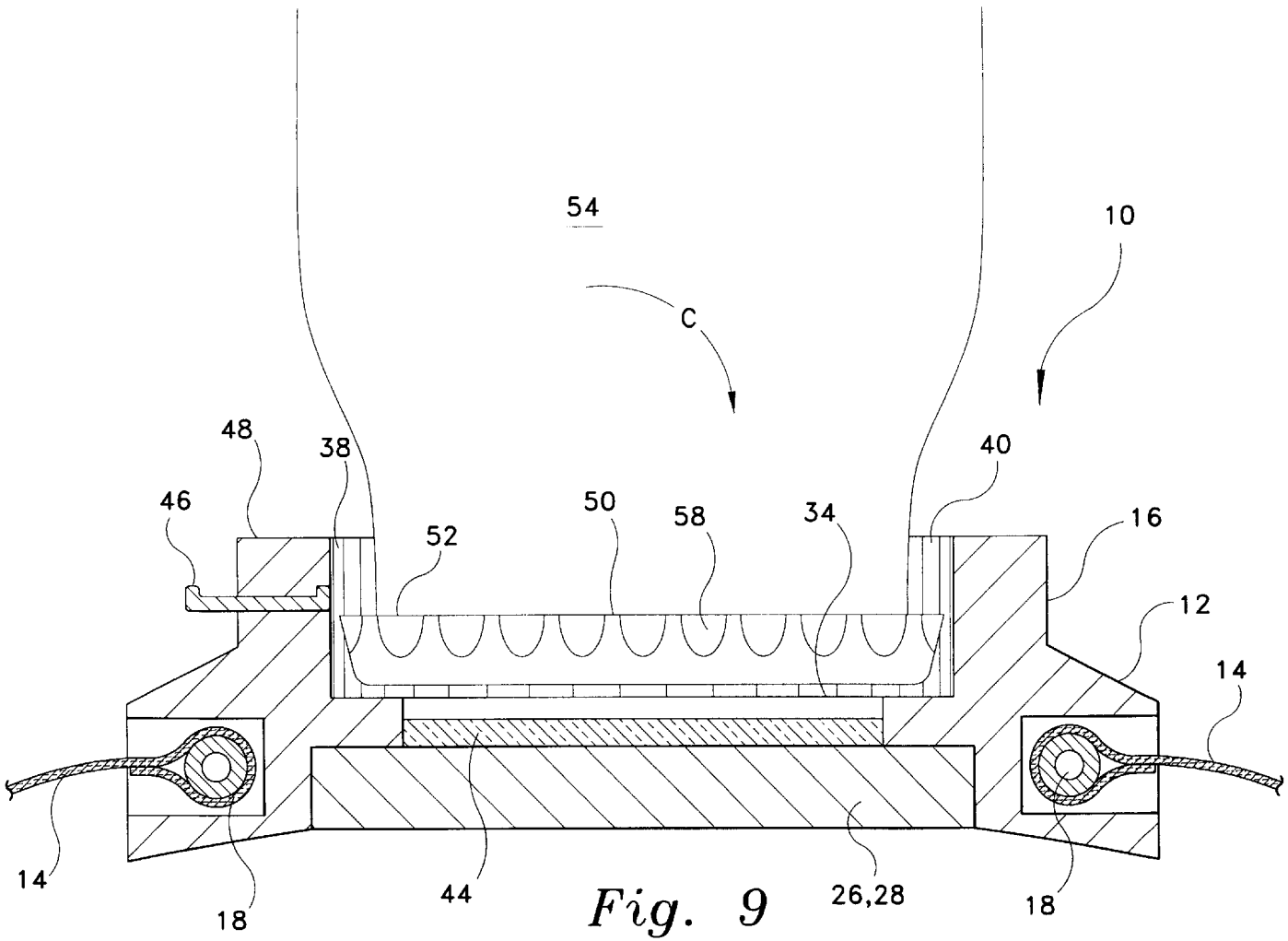
FIG. 9 is a side cross sectional view of a bottle opening device according to the present invention, showing the bottle opener being used for a pry-off bottle cap, with the hook retracted.
Figure 10:
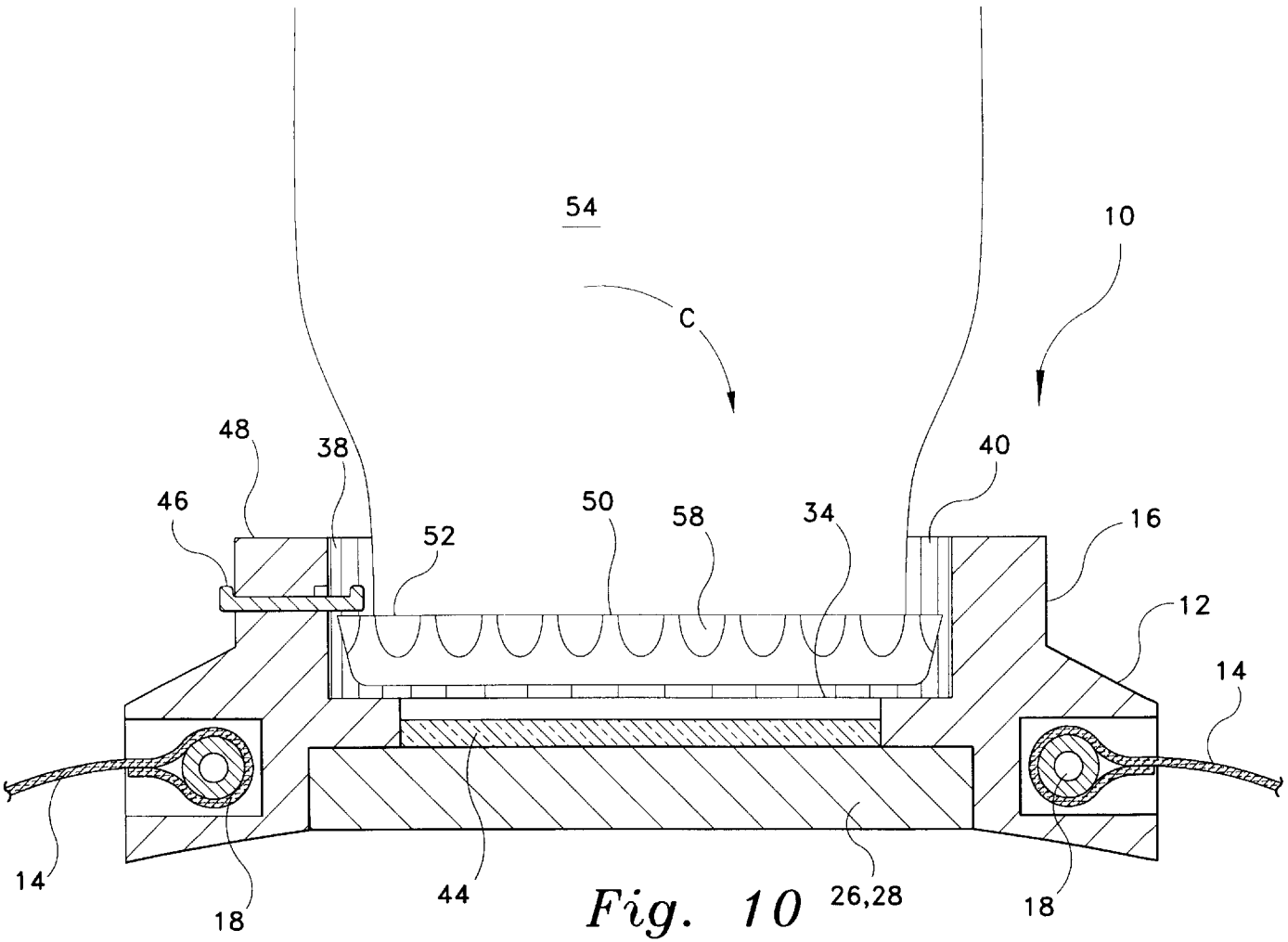
FIG. 10 is a side cross sectional view of a bottle opening device according to the present invention, showing the bottle opener being used for a pry-off bottle cap, with the hook extended.

The center of base 12 may include a magnet 24 for securing a bottle cap within the opener 10. Alternatively, referring to FIGS. 7–8, the base 12 may include an analog watch 26 (FIG. 8) or a digital watch 28 (FIG. 7). If a watch 26 or 28 is included, then magnet 24 should be omitted. Additionally, the base may include a sound emitter 30, such as a watch alarm, or a light emitter 32, possibly for reading the watch 26,28 in the dark. Referring to FIGS. 9–10, the crystal 44 of watch 26,28 is recessed to protect it from damage.

Referring back to FIGS. 2–6, circular member 16 extends upward from the front surface 34 of base 12. Circular member 16 has a hollow interior having a plurality of grooves 38 and ridges 40, configured to conform to the ridges and grooves of a typical bottle cap. The radius A to a ridge 40 is slightly greater than the radius to a bottle cap's groove, and slightly less than the radius a bottle cap's ridge. Likewise, the radius B to a groove 38 is slightly greater than the radius to a bottle cap's ridge. A typical bottle cap will have 21 ridges and 21 grooves around it's circumference, so the ridges 40 and grooves 38 will be sized accordingly. These dimensions will allow the circular member 16 to engage a twist-off bottle cap for removal. Additionally, circular member 16 will preferably have at least one opening 42, allowing for insertion of a finger for removal of a bottle cap from the opener 10. Referring back to FIGS. 7–8, if a watch 26,28 is included, circular member 16 will include at least two openings 42, allowing the watch to be worn on either hand with at least one opening 42 easily accessible.

Referring to FIGS. 9–10, the circular member 16 may include a hook 46 slidably mounted in close proximity to the outer edge 48 of circular member 16. Sliding hook 46 retracts to allow bottle cap 50 to enter the circular member 16, and then extends to hook under the bottom 52 of cap 50.

The use of the bottle opener 10 to open a twist off bottle cap 50 is illustrated in FIG. 1. The opener 10 remains on the wearer's wrist 56. The bottle cap 50 is inserted into circular member 16. The bottle 54 is then rotated clockwise. The ridges 40 of circular member 16 engage the ridges 58 (FIG. 9) of the bottle cap, causing cap 50 to rotate counterclockwise with the bottle 54 as the frame of reference. The user then inserts a finger into opening 42 to remove the bottle cap.

The use of the bottle opener 10 to open a pry-off bottle cap is illustrated in FIGS. 9–10. As before, the bottle opener 10 remains on the wearer's wrist 56. The user inserts bottle cap 50, with sliding hook 46 retracted. The user then extends hook 46 to hook under the bottom edge 52 of cap 50. By rotating bottle 54 in direction C, the hook applies upward pressure to one side of cap 50, and the top surface 34 of base 12 applies downward pressure to the cap 50, thereby prying the cap 50 off the bottle 54.

It is to be understood that the present invention is not limited to the embodiments described above, but encompasses any and all embodiments within the scope of the following claims.

I claim:

1. A bottle opening device for wearing on a wrist and a hand, and for removing a bottle cap from a bottle, said bottle opening device comprising:

a base having a top surface, a bottom surface, and a pair of opposite ends configured to receive a wristband;

a wristband having a first and a second end, said first end attached to one of said ends of said base, and said second end attached to the other of said ends of said base, said wristband for encircling a user's wrist; and a hollow circular member extending upward from said top surface of said base, said circular member having a plurality of ridges and grooves dimensioned and configured for engaging ridges and grooves of a bottle cap, said circular member having a groove radius and a ridge radius.

2. The bottle opening device according to claim 1, wherein said top surface of the base further comprises a magnet.

3. The bottle opening device according to claim 1, wherein said base includes a watch.

4. The bottle opening device according to claim 3, wherein said watch is digital.

5. The bottle opening device according to claim 3, wherein said watch is analog.

6. The bottle opening device according to claim 3, wherein said watch includes a crystal, said crystal being recessed.

7. The bottle opening device according to claim 1, wherein said base further comprises a sound emitting device.

8. The bottle opening device according to claim 7, wherein said sound emitting device is an alarm.

9. The bottle opening device according to claim 1, wherein said base further comprises a light emitting device.

10. The bottle opening device according to claim 1, wherein said band includes two portions secured by hook and loop fasteners.

11. The bottle opening device according to claim 1, wherein said circular member further comprises at least one opening.

12. The bottle opening device according to claim 1, wherein said circular member further comprises a hook, said hook being slidably movable between a retracted position wherein it permits entry of the bottle cap into said circular member, and an extended position wherein it engages a bottom surface of a bottle cap.

13. The bottle opening device according to claim 1, wherein said circular member's groove radius is slightly greater than a ridge radius of the bottle cap.

14. The bottle opening device according to claim 1, wherein said circular member's ridge radius is slightly greater than a groove radius of the bottle cap, and slightly less than a ridge radius of the bottle cap.

15. The bottle opening device according to claim 1, wherein said wristband is attached to said ends of said base by spring bars.

16. The bottle opening device according to claim 1, wherein said botttom surface of said base is curved to accomodate the curvature in a users's wrist.

* * * * *